US006971773B2

(12) United States Patent
Pape et al.

(10) Patent No.: US 6,971,773 B2
(45) Date of Patent: Dec. 6, 2005

(54) ADJUSTABLE LAMP HARP

(75) Inventors: Robert J. Pape, Ponte Vedra Beach, FL (US); Jason D. Patz, Jacksonville, FL (US)

(73) Assignee: Hunter Fan Company, Memphis, TN (US)

( * ) Notice: Subject to any disclaimer, the term of this patent is extended or adjusted under 35 U.S.C. 154(b) by 104 days.

(21) Appl. No.: 10/677,175

(22) Filed: Oct. 2, 2003

(65) Prior Publication Data

US 2005/0073842 A1 Apr. 7, 2005

(51) Int. Cl.[7] ..... F21V 17/06

(52) U.S. Cl. ..... 362/417; 362/277; 362/410; 362/433; 362/449

(58) Field of Search ..... 362/417, 418, 362/277, 433, 449, 410

(56) References Cited

U.S. PATENT DOCUMENTS 4,851,981 A 7/1989 Ruesch ..... 362/452
5,412,554 A * 5/1995 Lee ..... 362/449

* cited by examiner

*Primary Examiner*—Sandra O'Shea
*Assistant Examiner*—Mark Tsidulko
(74) *Attorney, Agent, or Firm*—Baker Donelson

(57) ABSTRACT

An adjustable harp is disclosed for use with a lamp (10) having a base (11) and a base bracket (20). The adjustable harp (25) is coupled to the base bracket (20). The harp (25) has a top member (26) and two oppositely disposed, legs (27). Each leg (27) has a top portion (31) and a bottom portion (32) telescopically mounted within the top portion (31). The harp has locking means to releasably lock the relative positions of the top and bottom portions.

4 Claims, 3 Drawing Sheets

ADJUSTABLE LAMP HARP

TECHNICAL FIELD

This invention relates generally to lamps, and more particularly to the harp of a lamp.

BACKGROUND OF THE INVENTION

Lamps have existed for many years. Typically, a lamp includes a base, a harp bracket mounted adjacent the top of the base, a light bulb socket, a light bulb, a U-shaped harp coupled to the bracket, and a lamp shade mounted to the top of the harp. The harp is sized and shaped to extend about opposite sides of the light bulb. The bracket has two arms which mate to the two bottom ends of the harp.

Today, light bulbs are manufactured in a variety of sizes and shapes. Oftentimes, a replacement light bulb is larger or shaped differently from the burned out light bulb which it replaces. This difference in size or shape may cause a problem as the replacement bulb may not fit within the width or height of the harp.

Lamp shades are also available in a variety of different sizes. A problem which may exist however is that when replacing one lamp shade with another of a different size the replacement lamp shade may not appear to match the lamp because of its position relative to the base. For example, the replacement lamp shade may appear to be positioned too close to the lamp base or too far from the lamp base. Obviously, if a lamp shade is positioned too close to the base one would have an additional problem of not being able to reach between the lamp shade and the base to gain access to the on/off switch which is typically positioned on the light bulb socket.

In an effort to resolve this problem extensions have been designed to bridge the base and harp, as shown in U.S. Pat. No. 4,851,981. These extensions however may become lost as they are utilized with some bulbs and stored in another location when rendered unnecessary with other bulbs. Furthermore, these extensions also limit the configuration of the harp to a single alternative. As such, some light bulbs still may not fit within the harp regardless of whether or not the extensions are utilized.

Accordingly, it is seen that a need remains for a lamp harp that can accommodate light bulbs or various sizes. It is to the provision of such therefore that the present invention is primarily directed.

SUMMARY OF THE INVENTION

In a preferred form of the invention an adjustable harp for use with a lamp having a base and a harp bracket having oppositely disposed harp mounting arms comprises a top member, and two oppositely disposed legs depending from said top member which are adapted to be coupled to the harp mounting arms. Each said leg has a first portion, a second portion telescopically received within the first portion, and locking means for locking the position of the first portion relative to the second portion. With this construction, the height of the adjustable harp may be varied by moving the first portion relative to the second portion and subsequently locking their position through the locking means.

DETAILED DESCRIPTION

Figure 1:
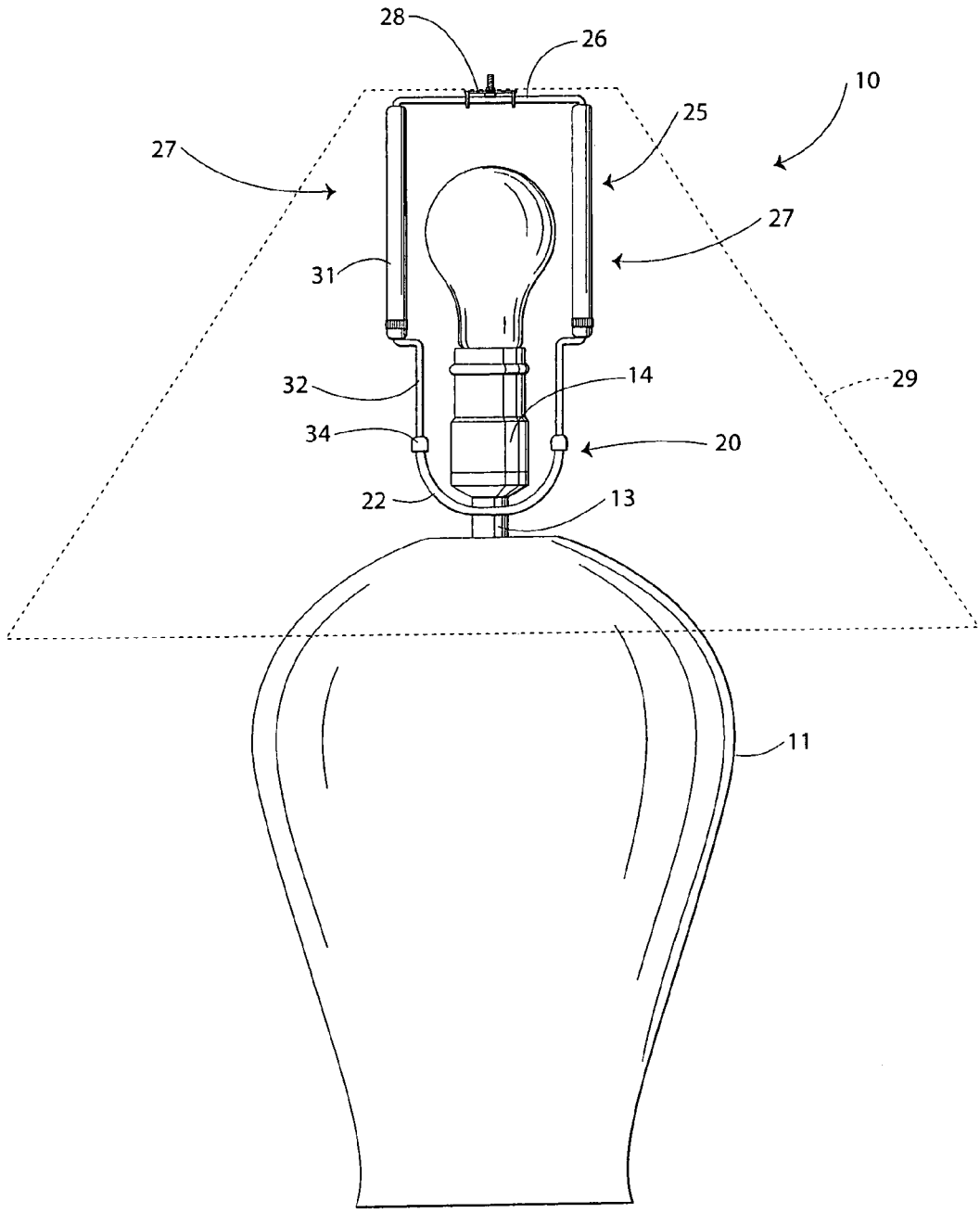
FIG. 1 is a side view of a lamp with a harp embodying principles of the invention in a preferred form.

With reference next to the drawings, there is shown a lamp 10 having a base 11 and an externally threaded nipple or hollow member 12 extending from the top of the base 11. The nipple 12 threadably extends through an internally threaded shoulder 13 and is threaded into the bottom of a light bulb socket 14.

A lamp harp base bracket 20 is journaled onto the nipple 12 in a positioned between the shoulder 13 and the socket 14. The conventional base bracket 20 has a central portion 21 through which the nipple 12 extends and two oppositely disposed arms 22 extending from the central portion 21. Each arm 22 has a generally vertical, internally facing receiving slot which is open through the top edge of the arm.

An adjustable harp 25 is coupled to the base bracket 20. The harp 25 has a top member 26 and two oppositely disposed, legs 27 depending downwardly from the top member 26. A threaded swivel 28 is mounted to the top member 26 to which is mounted a lamp shade 29. Each leg 27 has a top portion 31 and a bottom portion 32 telescopically mounted within the top portion 31. The bottom portion 32 has a bottom end 33 which is sized and shaped to be received within the slot of the base bracket arm 22. A sleeve 34 is journaled upon the bottom portion 32. The sleeve 34 is configured to extend over the top end of the base bracket arm 22 with the bottom end 33 of the bottom portion residing therein, as best shown in cross-section in FIGS. 2 and 3.

Figure 4:
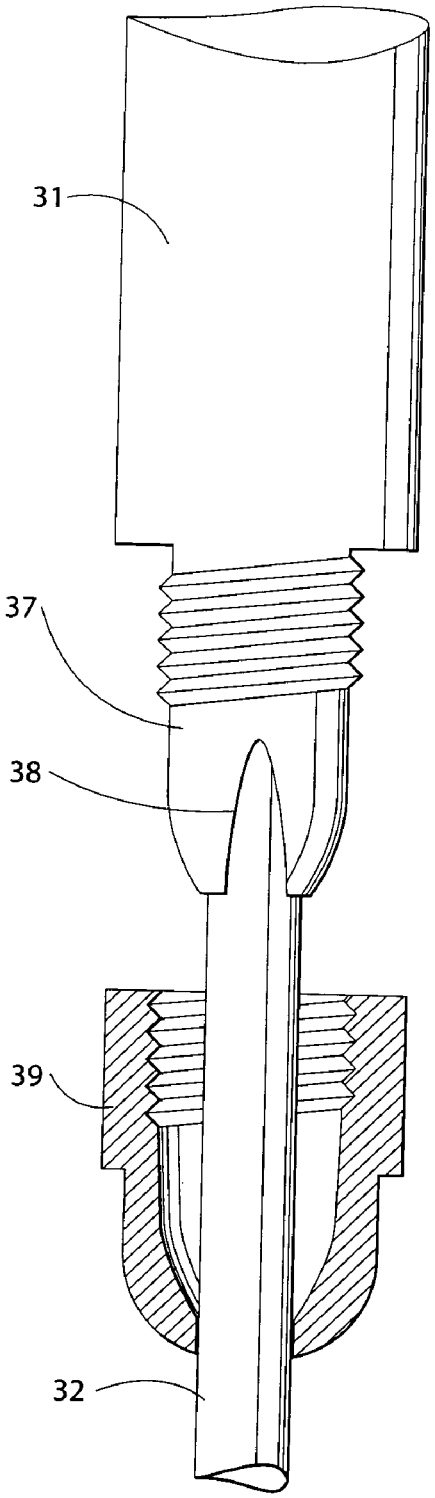
FIG. 4 is a cross-sectional view of the adjustment means portion of the harp of FIG. 1.

As best shown in FIG. 4, the harp has locking means to releasably lock the relative positions of the top and bottom portions. Here, the locking means includes each top portion 31 of the harp 25 having an externally threaded tapered end 37 with at least one slot 38 therein. An internally threaded and internally tapered cap or nut 39 is threadably coupled to the tapered end 37. The internal tapering or dimensions of the cap 39 coincide with the external tapering or dimension of the tapered end 37.

Figure 2:
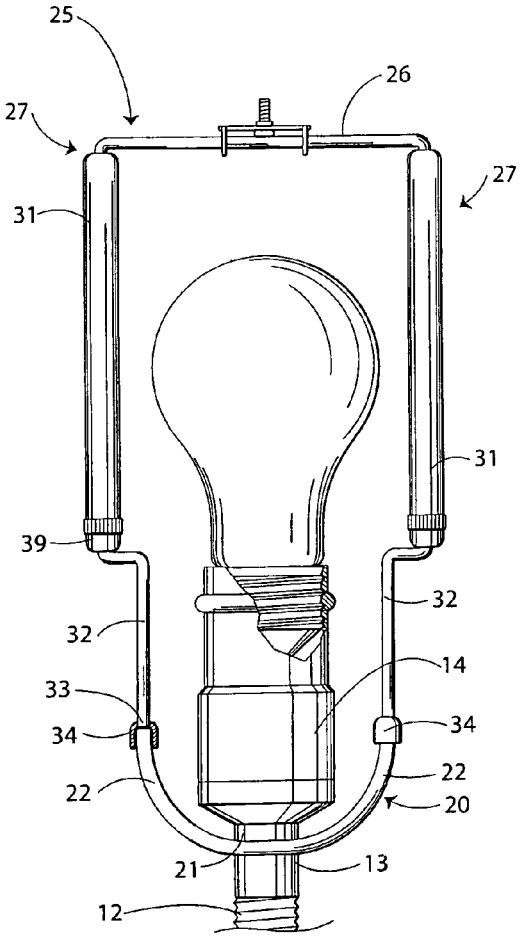
FIG. 2 is a side view of the harp of FIG. 1, shown in a retracted position and with select portions shown in cross-section.
Figure 3:
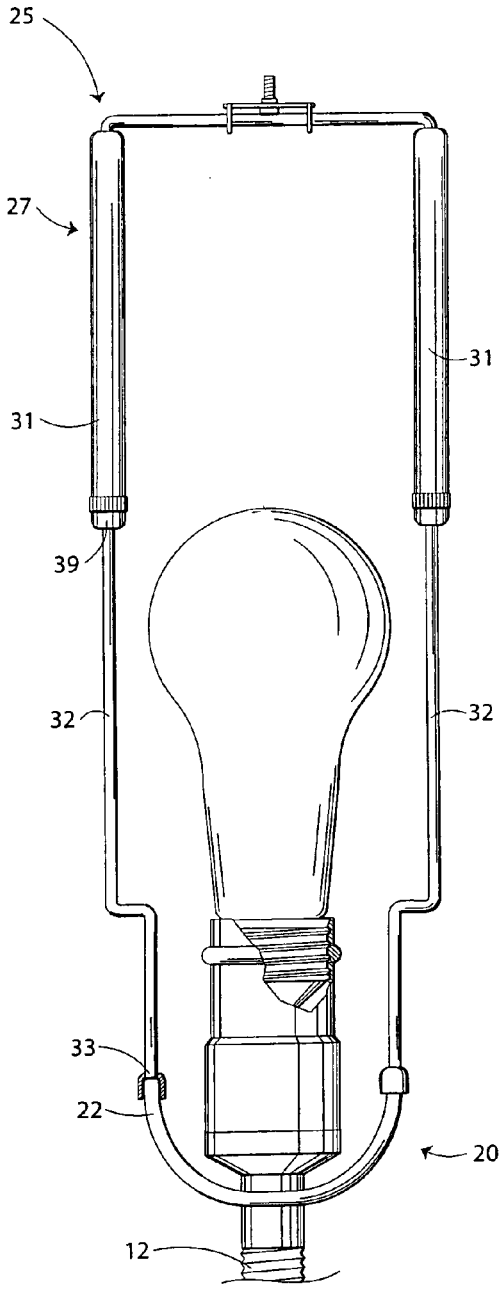
FIG. 3 is a side view of the harp of FIG. 1, shown in an extended position and with select portions shown in cross-section.

In use, the height or length of the harp 25 may be adjusted along an entire range between and including a retracted position shown in FIG. 2 and an extended position shown in FIG. 3. The length of the harp 25 is adjusted by unthreading or loosening the cap 39 from the tapered bottom end 33 of the top portion 31 and thereby allowing the slotted tapered end 37 to splay. The splaying of the tapered end decreases or releases the frictional contact between the tapered end 37 and the bottom portion 32 and thereby allows the top portion 31 to be telescopically moved along the bottom portion to any desired position along the range of positions. Once the desired position is found the operator retightens the cap 39 onto the threaded, tapered end 37. The threading of the cap 39 onto the end 37 causes the internal tapered surface of the cap 39 to contact the external tapered surface of the end 37. Further tightening of the cap 39 causes the tapered end 37 to be compressed along the slots 38, thereby bringing the tapered end 37 into greater frictional contact with the external surface of the bottom portion 32. As such, the position of the top portion 31 becomes locked relative to the bottom portion 32.

It should be understood that with the present invention the height or length of the harp may be adjusted to accommodate variations in the size of light bulbs or lamp shades. As such, the harp 25 may be adjusted downwardly to accommodate conventional shorter light bulbs, such as an A-19 light bulb shown in FIG. 2, or upwardly to accommodate longer light bulbs such as A-21 three-way bulbs such as that shown in FIG. 3, or any position between these extreme positions.

Figure 5:
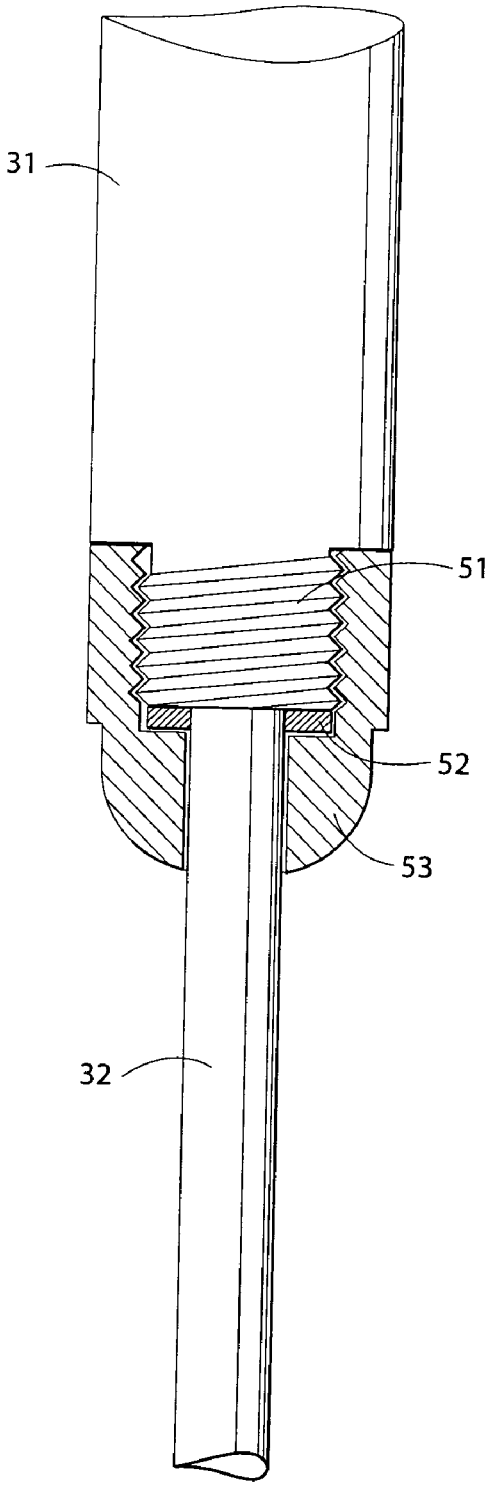
FIG. 5 is a cross-sectional view of the adjustment means portion of the harp in another preferred form.

With reference next to FIG. 5, there is shown an alternative embodiment of the harp adjustment or locking means. Here, the end 51 of the top portion 31 is not tapered and slotted to close or compress upon the bottom portion 32. Instead, a resilient compression washer 52 is positioned between the cap 53 and the end 51. The threaded tightening of the cap 53 onto the end 51 causes the compression washer 52 to be squeezed therebetween. The squeezing of the compression washer 52 causes it to expand or bulge against the external surface of the bottom portion 32. The frictional contact of the bulging washer 52 locks the relative position of the top portion 31 to the bottom portion 32.

It should be understood that other types of adjustment or locking means between top portion 31 and bottom portion 32 may be utilized as an alternative to those shown in the preferred embodiments. For example, the adjustment may be made through a rachet mechanisms, corresponding teeth, camming mechanisms, detent mechanisms, fasteners and the like.

It should be understood that the top member 26 and two legs depending therefrom may be made integrally with each other. Also, it should be understood that the relative positions of the top and bottom portions 31 and 32 may be reversed so that the top portion telescopes into the bottom portion.

It thus is seen that a lamp harp is now provided which may be adjusted to various lengths or heights and thus overcomes problems with those of the prior art. While this invention has been described in detail with particular references to the preferred embodiments thereof, it should be understood that many modifications, additions and deletions, in addition to those expressly recited, may be made thereto without departure from the spirit and scope of the invention as set forth in the following claims.

What is claimed is:

1. An adjustable harp for use with a lamp having a base and a harp bracket having oppositely disposed harp mounting arms, the adjustable harp comprising, a top member; and two oppositely disposed legs depending from said top member which are adapted to be coupled to the harp mounting arms, each said leg having a first portion, a second portion telescopically received within said first portion, and locking means for locking the position of said first portion relative to said second portion, said locking means comprises a threaded splayed end upon said first portion and a threaded cap configured to mate with said threaded splayed end, whereby the height of the adjustable harp may be varied by moving the first portion relative to the second portion and subsequently locking their position through the locking means, and whereby the threading of the cap upon the threaded end causes the compression of the splayed end.

2. An adjustable harp for use with a lamp having a base and a harp bracket having oppositely disposed harp mounting arms, the adjustable harp comprising, a top member; and two oppositely disposed legs depending from said to member which are adapted to be coupled to the harp mounting arms, each said leg having a first portion, a second portion telescopically received within said first portion, and locking means for locking the position of said first portion relative to said second portion, said locking means comprises said first portion having a threaded end, a threaded cap configured to mate with said threaded end, and resilient material positioned between said end and said cap, whereby the height of the adjustable harp may be varied by moving the first portion relative to the second portion and subsequently locking their position through the locking means, and whereby the threading of the cap upon the end causes the resilient material to expand and frictionally contact the second portion.

3. A lamp adjustable harp comprising, a top member extending to two oppositely disposed legs, each said leg including a first portion, a second portion telescopically received within said first portion, and locking means for locking the position of said first portion relative to said second portion along a range of positions between a telescopically retracted position and a telescopically extended position, said locking means comprises a threaded splayed end upon said first portion and a threaded cap configured to mate with said threaded splayed end, whereby the height of the adjustable harp may be varied by telescopically moving the second portion into the first position and then locking them relative to each other, and whereby the threading of the cap upon the threaded end causes the compression of the splayed end.

4. A lamp adjustable harp comprising, a top member extending to two oppositely disposed legs, each said leg including a first portion, a second portion telescopically received within said first portion, and locking means for locking the position of said first portion relative to said second portion along a range of positions between a telescopically retracted position and a telescopically extended position, said locking means comprises said first portion having a threaded end, a threaded cap configured to mate with said threaded end, and resilient material positioned between said end and said cap, whereby the height of the adjustable harp may be varied by telescopically moving the second portion into the first position and then locking them relative to each other, and whereby the threading of the cap upon the threaded end causes the resilient material to expand and frictionally contact the second portion.

* * * * *